United States Patent [19]

Katz

[11] 4,275,971

[45] Jun. 30, 1981

[54] MECHANICAL PENCIL

[75] Inventor: Otto Katz, Schwabach, Fed. Rep. of Germany

[73] Assignee: A.W. Faber-Castell, Stein bei Nuernberg, Fed. Rep. of Germany

[21] Appl. No.: 28,807

[22] Filed: Apr. 10, 1979

[30] Foreign Application Priority Data

Apr. 12, 1978 [DE] Fed. Rep. of Germany ..... 2815695

[51] Int. Cl.[3] ..... B43K 21/00

[52] U.S. Cl. ..... 401/80; 401/65

[58] Field of Search ..... 401/65–67, 401/80, 81, 84, 74

[56] References Cited

U.S. PATENT DOCUMENTS

| | | | |
|---|---|---|---|
| 1,234,666 | 7/1917 | Holmes | 401/80 |
| 1,488,385 | 3/1924 | BeWitt | 401/80 X |
| 1,839,897 | 1/1932 | Savoie | 401/81 |
| 2,166,751 | 7/1939 | Cooper | 401/65 |
| 2,503,080 | 4/1950 | Fefft et al. | 401/80 X |
| 2,533,513 | 12/1950 | Savoie | 401/80 X |
| 2,627,842 | 2/1953 | Russell | 401/65 |
| 3,836,265 | 9/1974 | Kapilow | 401/80 |
| 3,947,133 | 3/1976 | Kageyama et al. | 401/65 X |

*Primary Examiner*—Edward M. Coven

*Attorney, Agent, or Firm*—Michael J. Striker

[57] ABSTRACT

A mechanical pencil in which a tubular casing is formed with a lead-guiding passage which has a leading end open outwardly away from the casing. A lead is advanced through the passage by a collet movable between a first position in which the lead is clamped and a second position in which the lead is released. An element normally presses the lead, when the latter is in the passage, against an inner surface of the passage for preventing undesirable sliding of the lead along the passage when the collet releases the lead.

10 Claims, 6 Drawing Figures

MECHANICAL PENCIL

BACKGROUND OF THE INVENTION

The present invention relates to mechanical pencils.

Mechanical pencils are known in which a lead is advanced along a lead-advancing passage formed in a tubular casing. The tubular casing further includes a collet movable for advancing the lead between a closed position in which the lead is clamped and an open position in which the lead is released. The casing has a tip movable relative thereto and projecting normally outwardly away from the casing.

When the collet is open, the released lead tends to fall out of the casing, for example, due to the force of gravity should the pencil be in a substantially vertical position. Moreover, when the collet moves back from the open into the closed position, it slides along the lead. The friction between the slidable collet and the lead may cause a retracting movement of the latter together with the collet in direction inside the casing.

It has been suggested to provide the mechanical pencil with an elastic braking element surrounding the lead immediately adjacent the tip, for preventing the above-described undesired movements (i.e. slip) of the lead relative to the casing. Such a braking element frictionally engages the lead so as to develop a friction force sufficient to prevent the lead from falling out of the casing when the collet is open and eliminate any retracting movement of the lead together with the collet inwardly into the casing when the collet moves from the open into the closed position. However, such a friction force must be small enough to permit advancement of the lead when the collet moves from the closed towards the open position.

The braking element may be movable together with the tip which is movable axially inwardly into the casing as the lead is used up during writing or drawing. The braking element uniformly surrounds and supports the lead.

The tip may be urged into its ultimate forward position either by an end face of the collet or by a spring, so that the braking element moves the lead slightly forward. In this case the braking element has the additional function of moving the lead in direction outwardly of the casing.

It is known to provide a braking element of elastic synthetic plastic material, for example, rubber, which has an annular cross-section to encompass the lead and to develop friction between the inner surface of this braking element and the lead.

Such a braking element is, for example, described in German Pat. No. 18 15 535 and has a number of disadvantages.

The soft elastic synthetic plastic material of the braking element is very sensitive to abrasion (i.e. wear). This is especially true in the case of a very small contact surface between the braking element and the lead. Moreover, in time a braking element of such material changes its characteristics which leads to unpredictable and, therefore, uncontrollable changes in the friction engagement between the braking element and the lead. Such braking elements are produced in series (i.e. in great quantities); therefore, the characteristics of the braking elements, stipulated by the small size of the braking element and by shrinking of the material thereof, vary considerably.

Due to manufacturing considerations, the wall of the annular braking element has to be relatively thin. Therefore, such a braking element has a characteristic similar to that of a spring. Such a braking element is very sensitive to fluctuations in the diameter of the lead. Thus, the friction forces in the engagement between such a braking element and the lead may vary from one lead to another. Since the friction forces have to be overcome during the use of such a pencil, any increase of these forces may lead to hardening and roughening of the writing or drawing action. On the other hand, should the frictional forces be too small, then there is no guarantee that the lead is prevented from undesired sliding along the lead-advancing passage when the collet is open.

It has also been suggested to provide the tip of the mechanical pencil with a spring which normally urges the tip in direction outwardly of the casing. The tip, during the advancement movement causes a corresponding movement (i.e. slip) of the lead along the lead-guiding passage together with the tip. Thus, the length of the portion of the lead projecting beyond the tip includes a first portion achieved by the intentional advancement of the lead and a second portion stipulated by the controllable slip of the lead together with the tip. If the lead extends too far beyond the tip, it will easily break during writing or drawing. In order to avoid this, a user must adjust the position of the lead relative to the tip. Obviously, this additional adjustment involves additional unproductive time-consumption and is, generally-speaking, undesirably troublesome for the user.

SUMMARY OF THE INVENTION

It is a general object of the present invention to avoid the disadvantages of the prior art mechanical pencils.

More particularly, it is an object of the present invention to provide a mechanical pencil with a braking element which frictionally engages a lead with a force of a constant and relatively small value.

Another object of the present invention, is to provide a mechanical pencil with a braking element which is not sensitive to fluctuations of the diameter of a lead or to conditions of the outer surface thereof.

Still another object of the present invention is to provide a mechanical pencil with a braking element which eliminates any undesired sliding of a lead relative to a casing of the pencil.

Yet another object of the present invention, is to provide a mechanical pencil with a braking element which frictionally engages a lead with a force sufficient to prevent the lead from falling out of the pencil or from undergoing undersized retracting inwardly into the pencil.

A further object of the present invention is to provide a mechanical pencil with a braking element which is not sensitive to heat and the like.

Still a further object of the present invention is to provide a mechanical pencil with a braking element with a considerably reduced abrasion characteristic.

Yet a further object of the present invention is to provide a mechanical pencil with a braking element which can be manufactured and installed in a simple, fast and inexpensive manner.

In pursuance of these objects and others which will become apparent hereafter, one feature of the present invention resides in a mechanical pencil comprising an elongated tubular casing formed with a lead-guiding passage having a leading end open outwardly away from said casing and means for advancing a lead through said lead-guiding passage. The advancing means are removable between a first position in which the lead is clamped and a second position in which the lead is released. The lead tends to undesirably slide along said lead-guiding passage when the advancing means are in said second position and the lead is released.

According to one advantageous feature of the invention, the lead contained in the lead-guiding passage is pressed normally against an inner surface of the passage for preventing undesirable sliding of the lead along the passage when said advancing means release the lead.

According to another feature of the invention, the lead-pressing means include an elongated braking element engageable with the lead, when the latter is in said lead-guiding passage, and biasing means for pressing said element in direction towards and into said lead-guiding passage. The biasing means may constitute a spring ring integrally connected to said element and so located in said tubular casing as to normally press the element towards and into said passage.

In accordance with a preferred embodiment of the present invention, the braking element is manufactured from spring wire which is not sensitive at all to temperature fluctuations and practically does not have any abrasion even after being in use for a considerable length of time. Therefore, the characteristics and the biasing forces of the braking element remain practically the same during all the period of use of the mechanical pencil.

In accordance with still another feature of the present invention, the frictional forces in the engagement between the lead and the braking element remain the same even if the diameter of the lead fluctuates. In other words, the frictional forces in this engagement is a constant characteristic of the braking element for the time of use of the mechanical pencil.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF PREFERRED EMBODIMENTS

Figure 1:
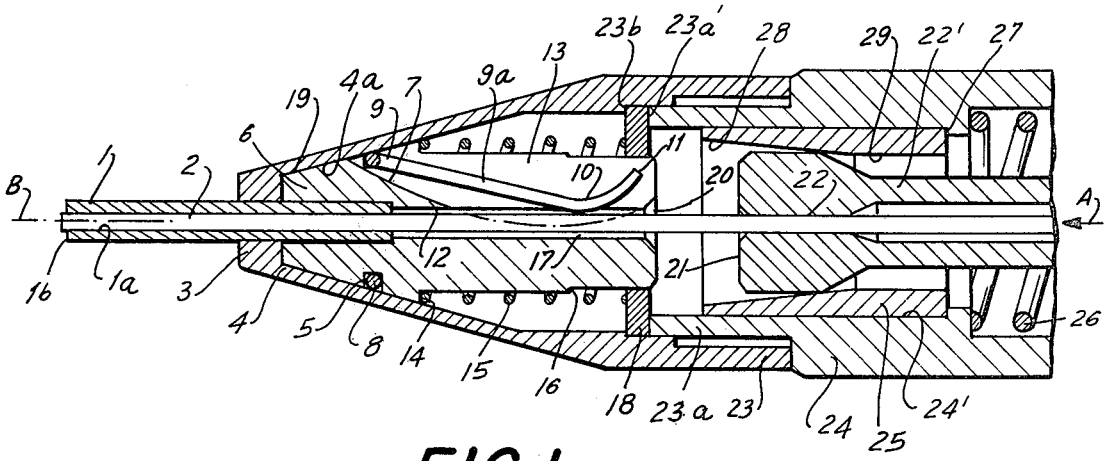
FIG. 1 is a partial axial cross-section through a mechanical pencil according to the present invention.
Figure 2:
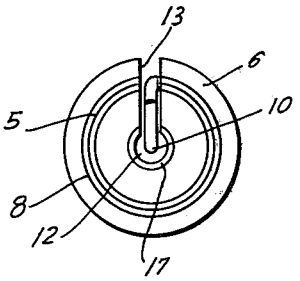
FIG. 2 is a view of a movable element as seen in the direction of arrow A in FIG. 1.

Referring now to the drawing and, more specifically, to FIG. 1 thereof, it may be seen that a mechanical pencil according to the present invention comprises an elongated tubular casing having a substantially cylindrically rear (i.e. as considered in direction of the arrow A shown in FIG. 1) casing part 24. A forward end portion of the casing part 24 is formed with a stepped annular recess forming an annular shoulder 23*a*.

The elongated tubular casing further comprises a slightly conical tubular part 3 (i.e. guide). A rear end portion of the guide 3 is formed with a likewise stepped bore forming a corresponding annular shoulder 23 that is adapted to engage the shoulder 23*a* so as to limit the outward movement of the guide 3 relative to the casing part 24.

A ring 18 is installed between a stop face 23*b* of the shoulder 23 and a stop face 23*a*′ of the shoulder 23*a*.

An element 6 is installed in the guide 3 for movement relative thereto axially along an axis B. The guide 3 is provided with an inner end face 4. The forward end region of the guide 3 bounds a contact surface 4*a* which defines a generally conical exterior section in which a conically-shaped forward portion 19 of the element 6 is normally loosely received. The element 6 is further provided with an outer circumferential shoulder 16 which is operative to engage the forward end face of the ring 18 when the element 6 moves axially towards the ring 18.

A tubular tip 1 is mounted in tight engagement, preferably press-fitted, in the forward end of an axial passage 12 of the element 6. Thus, the tip 1 moves together with the element 6. The tip 1 projects with its forward end portion outwardly away from the element 6 and beyond the guide 3 (see FIG. 1). The tip 1 has a central passage 1*a* coaxial with the passage 12 of the element 6.

Advancing means are coaxially arranged in the casing part 24 and includes a collet 22′ displaceable axially along the axis B relative to the casing part 24. The collet 22′ has a central passage 22 coaxial with the passage 12 of the element 6. The collet 22′ is surrounded by a tubular elongated member 25 which has an inner circumference comprising a substantially cylindrically rear part 29 and a substantially conical forward part 28. The conical part 28 diverges from the rear part 29 outwardly away relative thereto. The inner diameter of the rear part 29 corresponds to the outer diameter of the clamping end of the collet 22′.

When the collet is in a first position, i.e. in which the collet is surrounded and frictionally engaged by the rear part 29 of the member 25, the lead 2 is clamped. When the collet is in a second position, i.e. in which the collet is surrounded by the conical part 28 of the member 25 and can therefore recede from the lead, the lead 2 is released. The collet 22′ and the member 25 are movable together along a central hole 24′ of the casing part 24. The collet 22′ is also slidable relative to the member 25 after the latter abuts the rear end face of the ring 18. Thus, when the member 25 abuts the ring 18, the collet 22′ continues to move axially along the axis B and relative to the member 25 from the first position (i.e. tightly surrounded by the rear part 29) into the second position (i.e. loosely surrounded by the conical part 28). When the collet 22′ is loosely surrounded by the conical part 28, the collet 22′ opens and releases the lead 2.

The lead 2 is guided along the passage 12 of the element 6 and the passage 1*a* of the tip 1.

During movement of the collet 22′ from the first into second position, the lead 2 is advanced step by step through the passages 12 and 1*a* towards a forward end 1*b* of the tip 1. However, after advancing the lead 2 for one step, the collet has to be displaced from its second (i.e. open) position into its first (i.e. closed) position so as to clamp the lead 2 again for further advancement thereof.

The collet 22′ may be provided with a spring 26 which normally urges the collet into the first position. Thus, when the collet 22′ moves into the second position, the spring 26 becomes compressed. However, once the collet is open, the spring 26 returns the collet 22′ from the second position into the first position, that is the collet 22′ moves in direction opposite to that indicated by the arrow A. During such movement, the collet 22′ leaves the conical part 28 of the member 25 and frictionally engages the rear part 29. From that time on, the collet 22′ moves together with the member 25 away from the ring 18 until the member 25 abuts a corresponding end face 27. After that, the advancing movement of the collet 22′ with the lead 2 may be repeated.

The collet 22′, during its movement from the second into the first position, slides along the lead 2 which remains released until after the collet 22′ is in the second (i.e. closed) position. The passage 1*a* of the tip 1 and the passage 12 of the element 6 have an inner diameter slightly exceeding the outer diameter of the lead 2. Thus, the lead 2 becomes free to slide relative to the casing once the collet 22′ is open. Should the mechanical pencil be in a substantially vertical position, the lead 2 may fall out of the casing due to the force of gravity. Moreover, the lead 2 may move (i.e. slip) back into the casing together with the collet 22′ which moves from the second into the first position. Obviously both movements of the lead 2 are highly undesirable.

In order to prevent the undesired sliding of the lead 2 relative to the casing, the element 6 is provided with means for normally pressing the lead 2, when the latter is in the passage 12, against an inner surface 17 of the passage 12.

Figure 4:
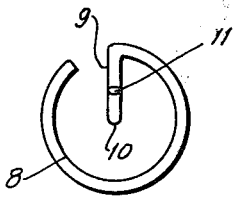
FIG. 4 is an end view of a braking element used in the embodiment of FIG. 1.
Figure 5:
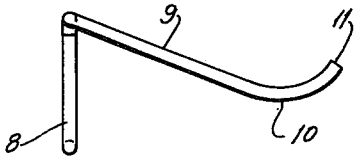
FIG. 5 is a side view of the braking element shown in FIG. 4.

The lead-pressing means include an elongated element 9 having a lever portion 9*a* located in an elongated recess 13 having an inner surface 7 and provided on the element 6. The element 9 is further provided with a circular portion 8 (see FIGS. 4 and 5) which is fixedly received (i.e. snapped) in a circumferential groove 5 provided on the element 6. The circular portion 8 extends substantially transversely to the elongation of the lever portion 9*a*. The element 9 is further provided with a rounded intermediate contacting portion 10 and a curved end portion 11. The groove 5 may have a V-shaped or trapezoidal cross-section so as to axially clearance-free receive therein the circular portion 8 of the spring element 9. Any other arrangement or shape of the groove 5 are possible in order to ensure that the circular portion 8 in its unmounted state is received in the groove 5 without any axial clearance.

Figure 6:
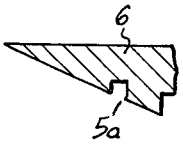
FIG. 6 is a partial sectional view of a guiding element having a groove to receive a lead-pressing means according to the invention.

The inner diameter of the groove 5 exceeds the corresponding inner diameter of the circular portion 8. The groove 5 may be provided with one or more projections 5*a* (as shown in FIG. 6) which at least partially overlap the groove 5. Thus, when the circular portion 8 is received (i.e. snapped) in the groove 5 the projections at least partially surround the circular portion 8 from outside thereof so as to prevent dislodging of the circular portion 8 from the groove 5. The groove 5 is so shaped that a distance between the side walls defining the groove 5, at the outer diameter of the groove 5 exceeds and the corresponding distance at the inner diameter of the groove 5 is smaller than the cross-sectional dimension of the wall of the circular portion 8. The forward conical portion 19 of the element 6 has the largest diameter exceeding and the smallest diameter which is smaller than the inner diameter of the circular portion 8.

The intermediate portion 10 and the curved end portion 11 extend along a section having one and the same radius.

Figure 3:
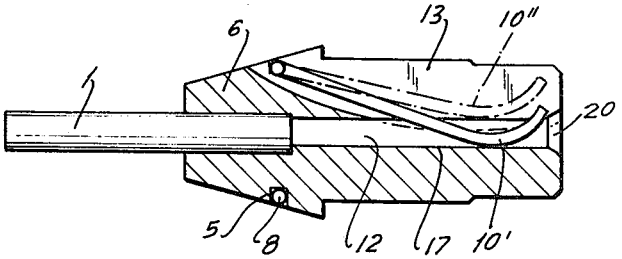
FIG. 3 is a longitudinal section through the element shown in FIG. 2.

The lower portion 9*a* of the spring element 9 is normally pressed towards and into the passage 12 of the element 6. Thus, when the passage 12 is empty, the lever portion is located in a first position 10′ (see FIG. 3), that is the intermediate contacting portion 10 completely and the curved end portion 11 at least partially are in the passage 12. In this position, the end portion 11 extends partially outwardly away from the passage 12. However, when the lead 2 enters the passage 12, the leading end of the lead 2 abuts the curved end portion 11 of the element 9. Upon further advancement by the collet 22′, the lead 2 moves further along the passage 12 towards the passage 1*a* of the tip 1 and, therefore, moves the lever portion 9*a* of the element 9 into a second position 10″ (see FIG. 3), that is outwardly away from the passage 12 and against the biasing force of the element 9. Due to the inherent tendency of the element 9 to return to its unstressed position (i.e. to full-line position), the contacting portion 10 of the element 9 presses the lead 2 against the opposite inner surface 17 of the passage 12. The biasing force of the element 9 may be so selected as to press the lead 2 against the counter surface 17 with a force sufficient to prevent the lead 2 against the sliding relative to the casing when the collet 22′ releases the lead 2. However, this force should be smaller than the advancing force of the collet 22′ so as not to prevent the advancement of the lead 2 by the collet 22′ through the passage 12 towards the forward end 1*b* of the tip 1.

The inner diameter of the passage 1*a* of the tip 1 is substantially equal to that of the passage 12 of the element 6, so that the pressing force applied onto the lead 2 from the element 9 at the contacting portion 10 will not result in braking the lead 2.

The recess 13 has a width smaller than the diameter of the lead 2.

The lead 2 is automatically fed in direction outwardly away of the tip 1 as a function of the exertion of axial pressure on the tip 1, i.e. on the forward end thereof, during writing or drawing. The tip 1 moves the element 6 axially from the end face 4 towards the ring 18. The lead 2 clamped by the collet 22′ remains stationary. Therefore, the tip 1, the element 6 and the element 9 slide along the lead 2 by a distance sufficient to expose a free portion of the lead 2, which is ready for use. Therefore, the friction between the passage 12 and the lead 2 pressed against the counter surface of the passage 12 by the element 9 must be small enough to permit easy movement of the element 6 and the tip 1 relative to the lead 2 during application of normal writing or drawing pressure.

As the free portion of the lead 2 is used up, the forward end 1*b* of the tip 1 again engages the writing or drawing surface and, thereafter, moves with the element 6 further towards the ring 18 to the extent that the lead 2 is used up.

When the circumferential shoulder 16 of the element 6 abuts the ring 18, the tip 1 can not move any further away from the writing or drawing surface. Thus, the process of continuous feeding the lead 2 is over. In order to restore the same, the element 6 has to be returned to its initial position, that is into engagement with the inner end face 4 of the guide 3.

The element 6 is provided with a spring 15 which is supported on the ring 18 and is operative for normally urging the element 6 towards and against the stop face 4 of the guide 3. The element 6 moves towards the ring 18 against the biasing force of the spring 15. The spring 15 may be so chosen, as to retract the element 6 once the circumferential shoulder 16 abuts the ring 18.

However, it is also possible to return the element 6 into its initial position during movement of the collet 22' forwardly during advancing of the lead 2. The collet 22' is actuated manually by an actuating button (not shown) which is located at a rear end of the casing part 24. The button is known per se and, therefore, does not require a detailed discussion or illustration. Thus, when the collet 22' moves fowardly (i.e. to the second position thereof), a forward end face 21 thereof may abut a rear end face 20 of the element 6 and move the latter towards and against the end face 4 of the guide 3.

The above-described mechanical pencil will operate as follows:

When ready for use, the writing end face of the lead is normally generally flush with the plane of the end face of the tip 1. During writing or drawing, the tip 1 engages the writing or drawing surface and is retracted to the extent that the lead 2 is used up. Thus, the element 6 is pushed inwardly towards the ring 18. The tip 1 slides along the lead 2 since the latter is clamped by the collet 22', and a small portion of the lead 2 is exposed, therefore, in a ready-for-use position, that is projecting outwardly beyond the plane of the end face of the tip 1. The friction between the outer surface of the lead 2 and the inner surface 17 of the passage 12 is overcome. When the free end of the lead 2 is used up, the shoulder 16 of the element 6 abuts the ring 18.

Thereafter, the element 6 has to be moved back into engagement with the stop face 4 of the guide 3. This can be done, for example, by engaging the front end face 21 of the collet 22' with the rear end face 20 of the element 6 during movement of the collet 22' from the first (i.e. closed) position to the second (i.e. open) position. The element 9 ensures that the lead 2 follows the axial movement of the element 6 correspondingly. The axial clearance-free engagement of the circular portion 8 of the spring element 9 with the grooves 5 prevents any inward movement of the lead 2 along the passage 12. When the collet 22' moves back into the first position to clamp the lead 2 for further advancement thereof, the element 9 prevents the lead 2 from falling out of the tubular casing. Thus, the lead 2 advances step-by-step forwardly towards the plane of the end face of the tip 1.

During writing or drawing the tip 1 engages the writing or drawing surface and is pushed inwardly into the guide 3, exposing a small portion of the lead 2. When this small portion is used up, the tip 1 moves further inwardly into the guide 3, exposing another small portion of the lead 2.

Thus, during writing or drawing, the tip 1 moves the element 6 towards the ring 18 compressing gradually the spring 15. Obviously, such movements of the tip 1 are not regular, rather follow each other in very short intervals.

It must be understood, that according to the present invention the automatic feeding of the lead 2 is accomplished without any slip of the lead 2 along the lead-guiding passage and relative thereto.

It will be understood that each of the elements described above, or two or more together, may also find a useful application in other types of mechanical pencils differing from the type described above.

While the invention has been illustrated and described as embodied in a mechanical pencil, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A mechanical pencil, comprising an elongated tubular casing formed with a lead-guiding passage having a leading end open outwardly away from said casing; means for advancing a lead through said lead-guiding passage, said means being movable between a first position in which the lead is clamped and a second position in which the lead is released, the lead tending to undesirably slide along said lead-guiding passage when the advancing means are in said second position and the lead is released; means for normally pressing the lead, when the latter is in said passage, against an inner surface of the passage for thereby preventing the undesirable sliding of the lead along the passage when said advancing means release the lead, including an elongated element engageable with the lead, when the latter is in said passage, and biasing means for pressing said element in direction towards and into said passage, said biasing means including a spring ring connected to said element and so located in said casing as to normally press the element towards and into said passage; means for mounting said lead-pressing means in said housing, said mounting means including a recess for so receiving said lead-pressing means therein as to permit the latter to press the lead against the inner surface of the passage when the lead is in said passage, and including a member mounted in said casing for movement relative thereto, said lead pressing means being so mounted on said member as to move together therewith, said recess being provided on said member; and wherein said member is further provided with a circumferential groove for rigidly receiving therein said spring ring, and a conical portion converging towards said leading end of said passage, said conical portion having a largest diameter exceeding and a smallest diameter smaller than the inner diameter of said spring ring.

2. A pencil as defined in claim 1, wherein said advancing means include a collet movable between said first and second positions and an actuating member for closing said collet when the latter is in said first position.

3. A pencil as defined in claim 2, wherein said actuating member has a recess, said collet moving in said recess during the displacement thereof between said first and second positions.

4. A pencil as defined in claim 3, wherein said recess has a conical portion for receiving said collet therein when the latter is in said second position.

5. A pencil as defined in claim 4, wherein said ring is integrally connected to said element.

6. A pencil as defined in claim 5, wherein said element includes a connecting portion engageable with the lead when the latter is in said passage and an end portion, said connecting and end portions of said element being curved so as to bound a section defined by a radius.

7. A pencil as defined in claim 6, and further comprising means for limiting the movement of said member in said casing and relative thereto.

8. A pencil as defined in claim 1, wherein said member is further provided with at least one projection partially overlapping said groove so that when said spring ring is received in said groove said projection at least partially covers said spring ring in said groove.

9. A pencil as defined in claim 1, wherein a first distance between the side walls defining said groove, at the outer surface of the member exceeds a corresponding second distance at the bottom of said groove.

10. A pencil as defined in claim 9, wherein said first distance exceeds a cross-sectional dimension of a side wall of said spring ring, said second distance being smaller than said cross-sectional dimension of the side wall of said spring ring.

* * * * *